US008082868B1

(12) United States Patent
Johnson

(10) Patent No.: US 8,082,868 B1
(45) Date of Patent: Dec. 27, 2011

(54) WATERCRAFT MOORING DEVICE

(76) Inventor: Alford R. Johnson, Carthage, TX (US)

( * ) Notice: Subject to any disclaimer, the term of this patent is extended or adjusted under 35 U.S.C. 154(b) by 171 days.

(21) Appl. No.: 12/322,795

(22) Filed: Feb. 6, 2009

(51) Int. Cl.
*B63B 21/00* (2006.01)
*B63B 22/02* (2006.01)

(52) U.S. Cl. ..... 114/230.1; 441/3

(58) Field of Classification Search ..... 114/230.1, 114/230.13, 230.19, 230.2, 230.24–230.27; 441/3
See application file for complete search history.

(56) References Cited

U.S. PATENT DOCUMENTS

| | | | | | |
|---|---|---|---|---|---|
| 2,354,441 | A | * | 7/1944 | Diehl | 441/3 |
| 2,413,596 | A | | 12/1946 | Wood, Jr. | |
| 3,371,640 | A | * | 3/1968 | Tsokalas | 114/121 |
| 3,425,069 | A | * | 2/1969 | Christians | 441/3 |
| 3,550,385 | A | * | 12/1970 | Hill et al. | 405/205 |
| 3,664,136 | A | * | 5/1972 | Laval et al. | 405/60 |
| 3,982,401 | A | * | 9/1976 | Loggins | 405/200 |
| 4,523,539 | A | | 6/1985 | Granger | |
| 4,632,051 | A | * | 12/1986 | Raymond et al. | 114/311 |
| 5,107,784 | A | * | 4/1992 | Lacy | 114/263 |
| 5,241,922 | A | | 9/1993 | Allen | |
| 5,394,817 | A | | 3/1995 | Kaufman | |
| 5,850,802 | A | | 12/1998 | Dvorak | |
| 5,970,917 | A | * | 10/1999 | Keith, Jr. | 119/223 |
| D416,224 | S | * | 11/1999 | Miknich | D12/215 |
| 6,065,239 | A | | 5/2000 | Thomas et al. | |
| 6,810,826 | B1 | | 11/2004 | Bellis, Jr. | |
| 7,269,921 | B2 | | 9/2007 | Lee | |

* cited by examiner

*Primary Examiner* — Daniel Venne
(74) *Attorney, Agent, or Firm* — Montgomery Patent & Design, LLC; Robert C. Montgomery; Joseph T. Yaksich

(57) ABSTRACT

A device which anchors a small boat to a tree stump is herein disclosed, comprising a section of resilient and inert material with an interior opening and is provided with a multitude of attaching apertures through its cross-section. These attaching apertures are connected to a plurality of three hundred (300) pound test nylon cords in a conical type fashion. The various sections of cord are also secured intermediately along its length thus producing a net structure not unlike that of a basketball net. The upper end of each cord is secured to a central point and is anchored with a section of five hundred (500) pound test nylon cord which is used to connect the device to a small boat. To use the device, the user slips the device over a tree stump or similar support structure protruding up through or just below the water surface. The net structure of the device provides a secure grip about the support structure no matter the direction of the boat in relation to the support structure.

15 Claims, 3 Drawing Sheets

WATERCRAFT MOORING DEVICE

RELATED APPLICATIONS

The present invention was first described in a notarized Official Record of Invention on May 6, 2008, that is on file at the offices of Montgomery Patent and Design, LLC, the entire disclosures of which are incorporated herein by reference.

FIELD OF THE INVENTION

The present invention relates generally to a mooring or anchoring device for a watercraft.

BACKGROUND OF THE INVENTION

Anchors are used from the smallest rowboat to the largest aircraft carrier to help hold these vessels in place while at a particular location. While anchors perform an admirable job, they do suffer from the fact that they are extremely heavy and bulky. Because of these limitations, other items may have to be left behind because of weight limitations of the vessel. Additionally, the deployment and retraction of anchors on small boats is often a very physical process and may require performance by those with a great deal of physical strength. Accordingly, there exists a need for a means by which small boats can be anchored to a specific location without the weight requirement of a conventional boat anchor. The development of the device disclosed herein fulfills this need.

In many areas where fresh water fishing is popular; many anglers prefer to fish from a boat such as a bass boat. Fish are frequently found in locations where the use of a traditional anchor is not practicable due to roots and other underwater obstructions. In these situations, many anglers will tie off to an obstruction. The device disclosed herein presents an alternative to fisherman in these situations by disclosing an anchor that is epically designed for these types of environments.

A device which anchors a small boat to a tree stump is herein disclosed, comprising a section of resilient and inert material that is approximately nine (9) inches in diameter with an eight (8) inch diameter interior opening. The ring is approximately three-quarters (¾) of an inch tall and is provided with a multitude of attaching apertures through its cross-section. These attaching apertures are connected to a plurality of three hundred (300) pound test nylon cords in a conical type fashion. The various sections of cord are also secured intermediately along its length thus producing a net structure not unlike that of a basketball net. The upper end of each cord is secured to a central point and is anchored with a section of five hundred (500) pound test nylon cord which is used to connect the device to a small boat. To use the device, the user slips the ring over a tree stump or similar support structure protruding up through or just below the water surface. The net structure of the device provides a secure grip about the support structure no matter the direction of the boat in relation to the support structure.

There have been attempts in the past to invent improved anchors for watercraft. U.S. Pat. No. 7,269,921 issued to Lee discloses a fishing net device that appears to be attachable to watercraft. Unfortunately, this patent does not appear to disclose a mooring device for watercraft.

U.S. Pat. No. 6,810,826 issued to Bellis discloses an anchoring system for boat that permits a user to deploy the anchor from the side or rear of the boat. Unfortunately, this patent does not appear to disclose a mooring device for watercraft that comprises a ring with a plurality of attaching apertures connected to a plurality of three hundred (300) pound test nylon cords in a conical type fashion producing a net structure that is attached to watercraft.

U.S. Pat. No. 416,224 issued to Miknich discloses a lightweight boat anchor comprising a base member and a net like structure attached to the base portion. Unfortunately, this design patent does not appear to be similar in appearance to the disclosed device, nor does it appear to comprise a ring that may be slid onto a submerged tree stump to moor watercraft.

U.S. Pat. No. 347,206 issued to Smith discloses an anchor. Unfortunately, this design patent does not appear to be similar in appearance to the disclosed invention.

U.S. Pat. No. 6,273,017 issued to Griffin discloses a boat mooring device that comprises an elongate handle with a flexible mooring line with a loop to attach a mooring post or stump. Unfortunately, this patent does not appear to disclose a net-like mooring device that may be placed over submerged tree stumps.

U.S. Pat. No. 6,065,239 issued to Thomas et al. discloses a twist closure drop fishing net that comprises an upper float ring, a lower weight ring, and a net formed in a generally tubular configuration. Unfortunately, this patent does not appear to disclose a mooring device for watercraft.

U.S. Pat. No. 6,062,158 issued to Blanchard discloses a watercraft mooring device comprising a stainless steel cage with upper and lower rings connected by a plurality of risers. Unfortunately, this patent does not appear to disclose a mooring device for watercraft that comprises a ring with a plurality of attaching apertures connected to a plurality of three hundred (300) pound test nylon cords in a conical type fashion producing a net structure that is attached to watercraft.

U.S. Pat. No. 5,394,817 issued to Kaufman discloses a collapsible drift sock that comprises a cylindrical tubular body with a mooring line and a flow control line which is arranged to control the size or magnitude of the outlet of the cylindrical tubular body, thereby constricting the flow of water through the cylindrical tubular body. Unfortunately, this patent does not appear to disclose a watercraft mooring device that is capable of being placed over submerged tree stumps.

U.S. Pat. No. 5,241,922 issued to Allen discloses a collapsible sea anchor that comprises two (2) sheets of a flexible material sewn together to create a generally frustum-shaped collapsible body with at least one (1) fin and a flexible stiffener. Unfortunately, this patent does not appear to disclose a mooring device for watercraft that comprises a ring with a plurality of attaching apertures connected to a plurality of three hundred (300) pound test nylon cords in a conical type fashion producing a net structure that is attached to watercraft.

U.S. Pat. No. 5,154,131 issued to Hall discloses an anchor which attaches to a tree, stump or other stationary object comprising a clamping device, a pair of tongs attached to and extending from the clamping device, and an anchor line to attach the anchor to the boat. Unfortunately, this patent does not appear to disclose a net like structure attached to a support ring that may be placed over an object to maintain watercraft in position.

U.S. Pat. No. 4,632,051 issued to Raymond et al. discloses a sea anchor comprising a hollow and baseless truncated body with a wide mouth member at the edge of the cone base of strong material forming a hollow, generally truncated body which is attached to a wide mouth strength member and in which the strong material has orifices in it so as to cause energy dissipation by the increased velocity. Unfortunately, this patent does not appear to disclose a mooring device for watercraft that comprises a ring with a plurality of attaching apertures connected to a plurality of three hundred (300)

pound test nylon cords in a conical type fashion producing a net structure that is attached to watercraft.

U.S. Pat. No. 3,945,335 issued to Kratz discloses a boat docking device comprising a pair of rigid arms where the rearward ends of these arms are formed to provide cooperating jaws for clamping relationship upon an interposed implement. Unfortunately, this patent does not appear to disclose a net like structure attached to a ring that is capable of being placed over a submerged object to moor watercraft.

SUMMARY OF THE INVENTION

In light of the disadvantages as previously discussed in the prior art, it is apparent that there is a need for a watercraft mooring device which provides a means for anchoring a watercraft to a tree stump thus securing said watercraft in a stationary position.

An object of the watercraft mooring device is to enable a user to moor or anchor a watercraft without the drawbacks presented by standard anchoring systems, such as numerous hang ups, dredging debris, and the like.

Another object of the watercraft mooring device is to permit anchoring of a watercraft even in locations where no anchor points or the like are available using an integral weighted member that may be sunk to the water body floor.

A further object of the watercraft mooring device comprises an internal weighted member which is preferably of adequate mass such that the device will sink when placed in a body of water, such as metal, weighted granules, or the like.

Still another object of the watercraft mooring device comprises a torus body that is approximately nine (9) inches in diameter with an inner diameter of approximately eight (8) inches, so that the device may fit over and around anchor points from approximately two (2) to seven (7) inches in diameter.

Still a further object of the watercraft mooring device are cord sections and intermediate rings are preferably made of a three-hundred (300) pound test nylon cord or similarly durable material.

An aspect of the watercraft mooring device comprises a torus body and a plurality of cord sections with a plurality of intermediate rings secured along the length of said cord sections, similar to that of an inverted basketball net.

Another aspect of the watercraft mooring device comprises cord sections that securely attach to the torus body at a plurality of cord attachment points. The cord sections and intermediate rings form a generally conical shape and terminate at and are secure to a central connector.

A further aspect of the watercraft mooring device comprises an anchor cord which is preferably a length of five-hundred (500) pound test nylon cord or similarly durable material attaches to the connector and provides a means to attach the device to the watercraft via a knot, a clamp, or the like.

Still another aspect of the watercraft mooring device comprises an outer cover that provides a protective surrounding to the weighted member and is preferably made of a waterproof material which will keep said weighted member dry in order to prevent rust or other damage thereto.

Still a further aspect of the watercraft mooring device comprise a plurality of eyelets each connected to an end of the cord section. The eyelets and the cord sections are attached to the torus body via a plurality of fasteners which are preferably a rust-resistant hardware. The fasteners are inserted through an eyelet through a hole which is aligned over a fastening aperture located in the torus body.

A method of utilizing the device may be achieved by performing the following steps: utilizing a watercraft in a normal manner on a body of water; approaching a desired anchoring location; locating an anchor point which is either above the water line or below the water line; lowering said device around an upper portion of said anchor point via the anchor cord; securing said anchor cord to the watercraft; performing desired activities while securely moored to said anchor point; raising the device from an upper portion of said anchor point via retracting the length of said anchor cord; storing said device in the watercraft; utilizing said device similar to a standard anchor when said anchor point is not available by lowering said device to the water body floor.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | watercraft mooring device |
| 20 | torus body |
| 22 | weighted member |
| 24 | outer cover |
| 30 | cord sections |
| 35 | intermediate ring |
| 40 | cord attachment points |
| 42 | eyelet |
| 44 | crimped end |
| 46 | fastener |
| 48 | fastening aperture |
| 50 | anchor cord |
| 55 | connector |
| 100 | tree stump |
| 105 | body of water |
| 110 | water body floor |

DETAILED DESCRIPTION OF THE PREFERRED EMBODIMENT

Figure 1:
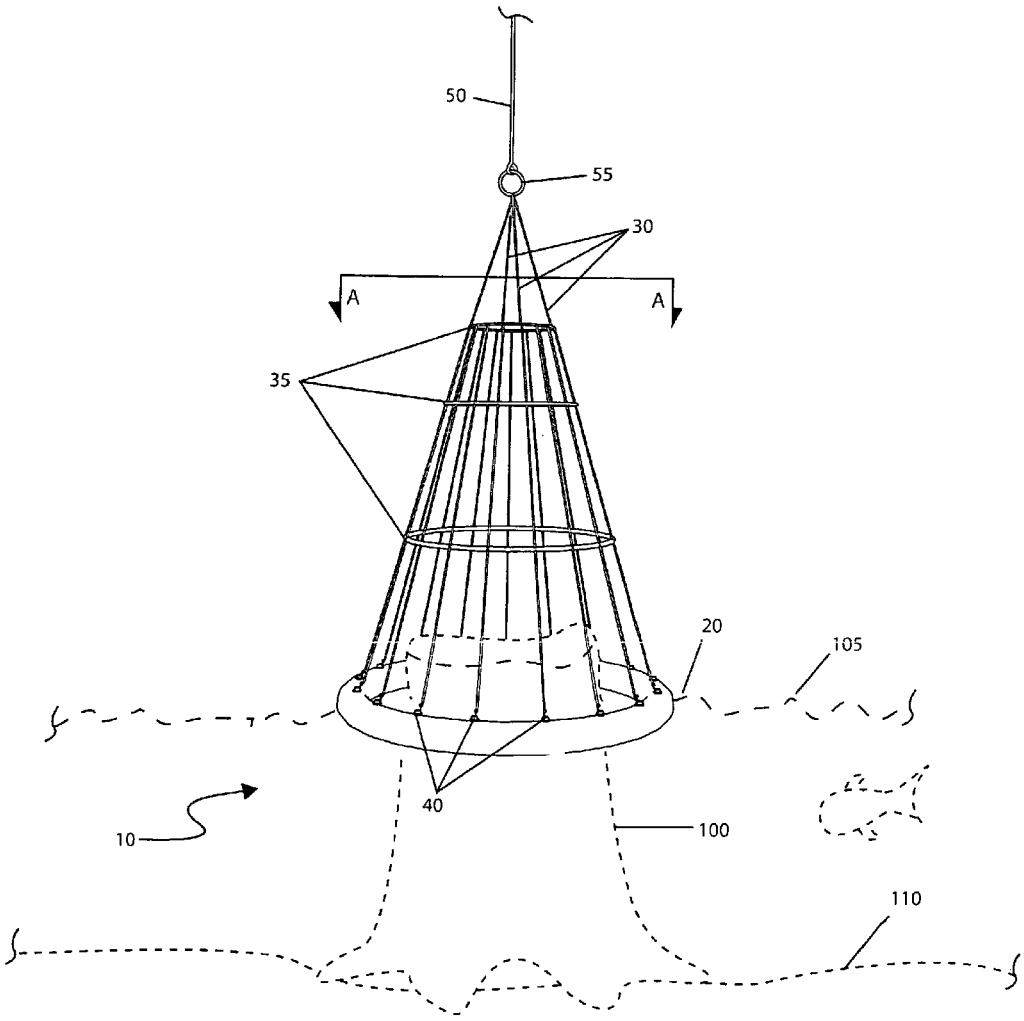
FIG. 1 is an environmental view of a watercraft mooring device 10 depicting a first mode of use, according to a preferred embodiment of the present invention.
Figure 2:
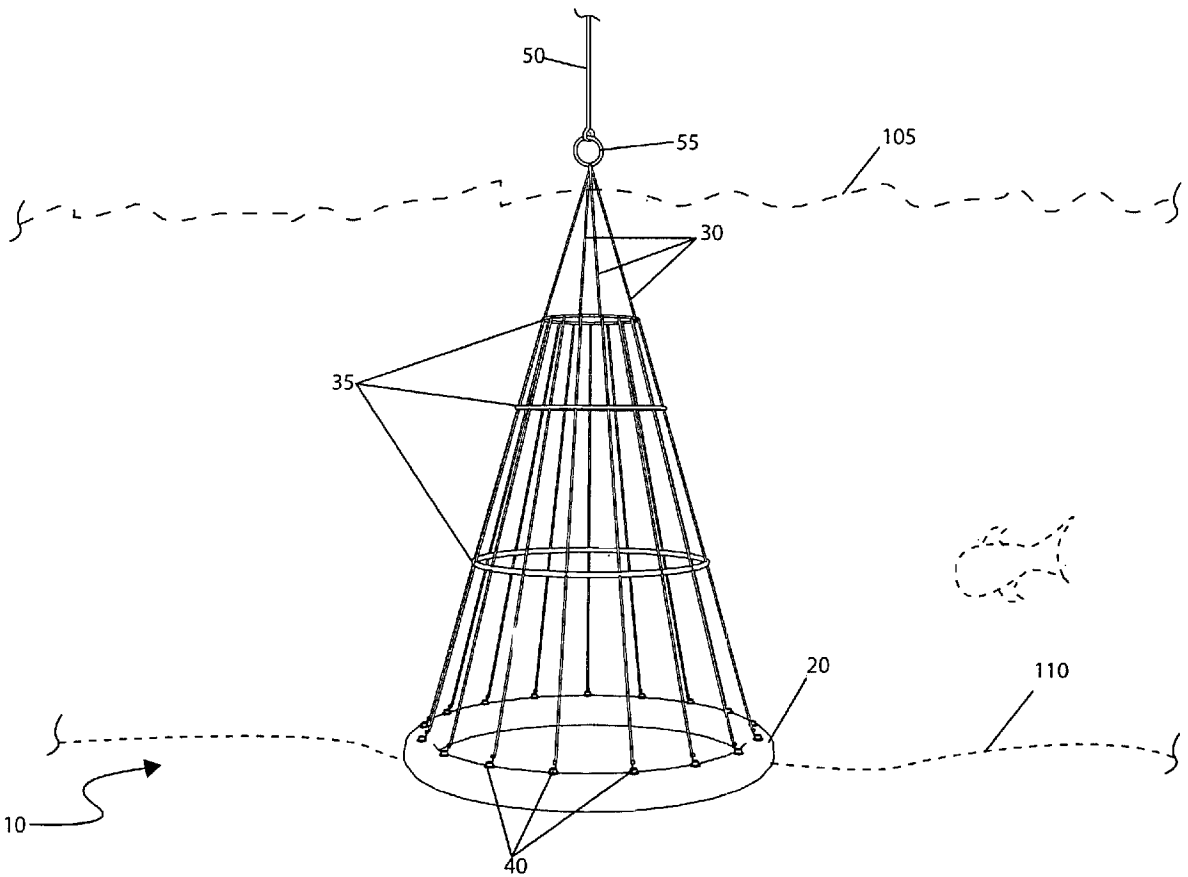
FIG. 2 is an environmental view of a watercraft mooring device 10 depicting a second mode of use, according to a preferred embodiment of the present invention; and, FIG. 3 is a section view taken along line A-A of a watercraft mooring device 10, according to a preferred embodiment of the present invention.
Figure 3:
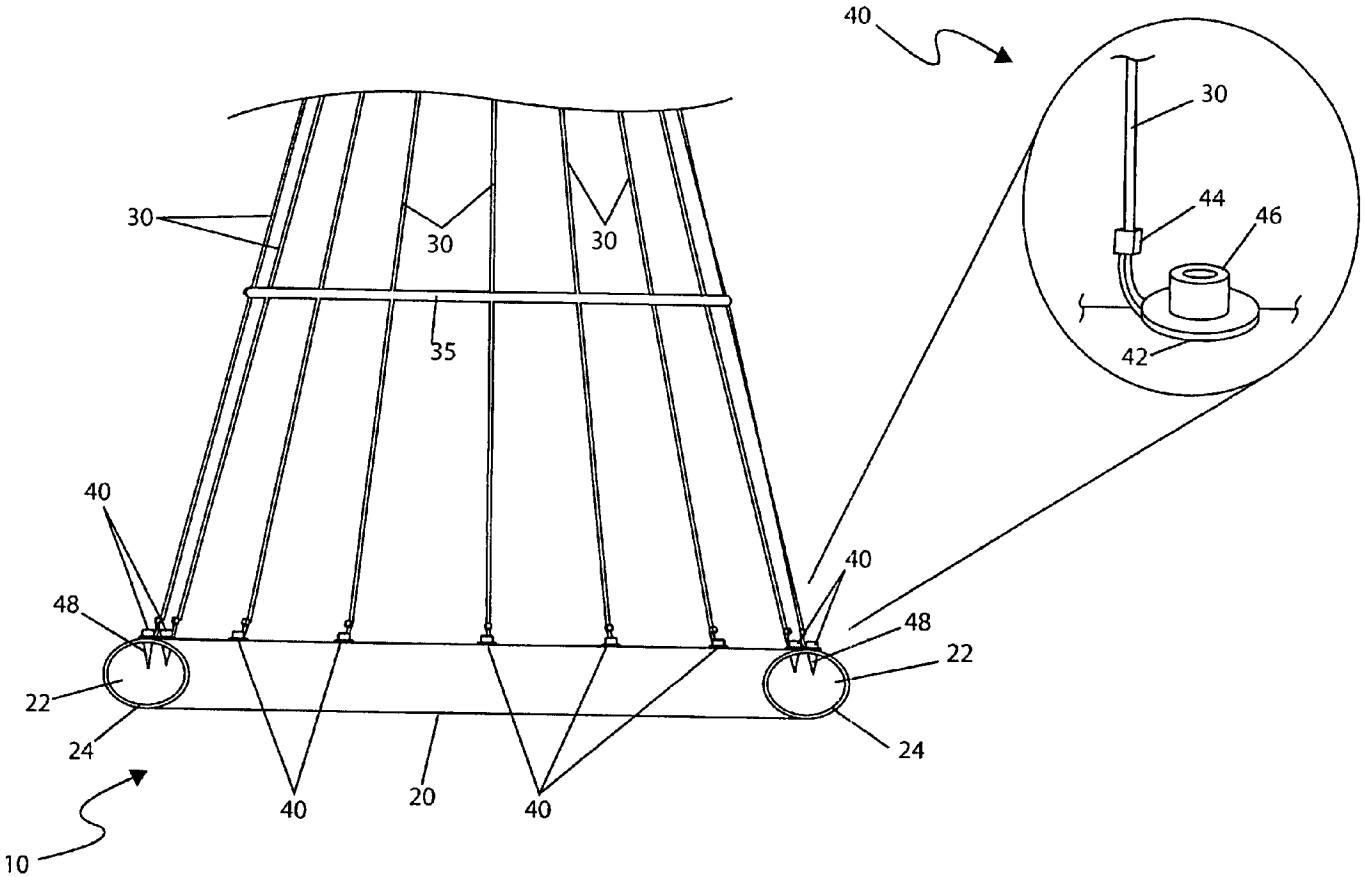

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a watercraft mooring device (herein described as the "device") 10, which provides a means for anchoring a watercraft to a tree stump 100 thus securing said watercraft in a stationary position. The device 10 generally comprises a torus body 20 and a plurality of cord sections 30 with a plurality of intermediate rings 35 secured along the length of said cord sections 30, similar to that of an inverted basketball net, which may slip thereover a tree stump 100 and then may be easily removed therefrom the same. Utilization of the device 10 enables a user to moor or anchor a watercraft without the drawbacks presented by standard anchoring systems, such as numerous hang ups, dredging debris, and the like.

Referring now to FIGS. 1 and 2, environmental views of the device 10, according to the preferred embodiment of the present invention, are disclosed. The device 10 comprises two (2) modes of use. The first mode of use (see FIG. 1) enables the device 10 to moor the watercraft thereto a tree stump 100 or the like; said tree stump 100 may be above the water line 105 or below said water line 105. The torus body 20 is approximately nine (9) inches in diameter with an inner diameter of approximately eight (8) inches, such that the device 10 may fit thereover and therearound tree stumps 100 from approximately two (2) to seven (7) inches in diameter. The cord sections 30 securely attach thereto the torus body 20 thereat a plurality of cord attachment points 40. The cord sections 30 and intermediate rings 35 are preferably made of a three-hundred (300) pound test nylon cord or similarly durable material. The cord sections 30 and intermediate rings 35 form a generally conical shape and terminate thereat and are secure thereto a central connector 55. An anchor cord 50 which is preferably a length of five-hundred (500) pound test nylon cord or similarly durable material attaches thereto the connector 55 and provides a means to attach the device 10 thereto the watercraft via a knot, a clamp, or the like.

The second mode of use (see FIG. 2) enables the device 10 to anchor the watercraft thereto a water body floor 110 in a manner similar to that of traditional anchors. When the watercraft is in a location where no tree stumps 100 or the like are available; the device 10 may be sunk to the water body floor 110 and provides an anchoring means thereto said watercraft due to an integral weighted member 22.

Referring now to FIG. 2, a section view taken along section line A-A of the device 10, according to the preferred embodiment of the present invention, is disclosed. The torus body 20 comprises an internal weighted member 22 which is preferably of adequate mass such that the device 10 will sink when placed in a body of water 105, such as metal, weighted granules, or the like. Given a location where a tree stump 100 is below the water 105 line or where no tree stump 100 is available, the device 10 is capable of sinking and making contact with a mooring or an anchoring surface 100, 110. An outer cover 24 provides a protective surrounding thereto the weighted member 22 and is preferably made of a waterproof material which will keep said weighted member 22 dry in order to prevent rust or other damage thereto. An eyelet 42 is connected thereto an end of the cord section 30 thereat the connection point 40. The eyelet 42 is preferably made of a durable, rust-resistant material and attaches thereto the cord section 30 via a crimped end 44. The eyelets 42 and thus the cord sections 30 are attached thereto the torus body 20 via a plurality of fasteners 46 which are preferably a rust-resistant hardware fastener such as a screw or the like. The fasteners 46 are inserted therethrough an eyelet 42 through hole which is aligned thereover a fastening aperture 48 located therein the torus body 20. Although illustrated comprising eyelets 42 which are crimped thereto the cord sections 30 and attached thereto an upper surface of the torus body 20 via fasteners 46; it is understood that the attachment points 40 may be introduced comprising various other attachment means having equal benefit, such as threading the cord sections 30 therethrough a cross-sectional through hole therethrough said torus body 20, fastening said cord sections 30 thereto a bottom surface of said torus body 20, or the like and as such should not be viewed as a limiting factor of the present device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 and 2.

The method of utilizing the device 10 may be achieved by performing the following steps: utilizing a watercraft in a normal manner thereon a body of water 105; approaching a desired anchoring location; locating a tree stump 100 which is either above the water 105 line or below the water 105 line; lowering said device 10 therearound an upper portion of said tree stump 100 via the anchor cord 50; securing said anchor cord 50 thereto the watercraft; performing desired activities while securely moored thereto said tree stump 100; raising the device 10 therefrom an upper portion of said tree stump 100 via retracting the length of said anchor cord 50; storing said device 10 therein the watercraft; utilizing said device 10 similar to a standard anchor when said tree stump 100 is not available by lowering said device 10 to the water body floor 110.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A watercraft mooring device, comprising:

a torus body;

a plurality of cord sections each comprising a distal end attached along a periphery of said torus body and extending outwardly therefrom, and a proximal end attached thereto a cord connector;

a plurality of intermediate rings attached around said plurality of cord sections respectively; and, an anchor cord connected thereto said cord connector at a first end to attach said device thereto a watercraft at a second end;

wherein said device enables a user to moor or anchor said watercraft;

wherein one of said intermediate rings is connected to each of said cord sections, said one intermediate ring being located between said first and second ends of said cord sections, said one intermediate ring being spaced above said torus body;

wherein said first end is a bottom most end of said anchor cord, said first end being connected to said cord connector.

2. The device of claim 1, wherein said torus body comprises a weighted member therein.

3. The device of claim 2, wherein said weighted member comprises a metal.

4. The device of claim 1, wherein said plurality of cord sections are each attached thereto said periphery of said torus body thereat a plurality of cord attachment points by a fastener means.

5. The device of claim 4, wherein said fastener means comprises an eyelet.

6. The device of claim 1, wherein said plurality of cord sections comprise a three-hundred (300) pound test cord.

7. The device of claim 1, wherein said plurality of intermediate rings comprise a three-hundred (300) pound test cord.

8. The device of claim 1, wherein said device forms a conical shape.

9. The device of claim 1, wherein said anchor cord comprises a five-hundred (500) pound test cord.

10. The device of claim 1, wherein said torus body is approximately nine (9) inches in diameter.

11. The device of claim 1, wherein said torus body is approximately eight (8) inches in inner diameter.

12. A method for using a watercraft mooring device, said method comprising the steps of:

providing said device, comprising:

a torus body;

a plurality of cord sections each comprising a distal end attached along a periphery of said torus body and extending outwardly therefrom, and a proximal end attached thereto a cord connector;

a plurality of intermediate rings attached around said plurality of cord sections respectively; and, an anchor cord connected thereto said cord connector at a first end to attach said device thereto a watercraft at a second end;

wherein said device enables a user to moor or anchor said watercraft;

utilizing said watercraft thereon a body of water;

approaching a desired anchoring location;

locating an anchor point which is either above a water line or below said water line;

lowering said device around an upper portion of said anchor point via said anchor cord respectively; and, securing said anchor cord thereto said watercraft;

wherein one of said intermediate rings is connected to each of said cord sections, said one intermediate ring being located between said first and second ends of said cord sections, said one intermediate ring being spaced above said torus body;

wherein said first end is a bottom most end of said anchor cord, said first end being connected to said cord connector.

13. The method of claim 12, further comprising the additional step of raising said device therefrom an upper portion of said anchor point via retracting a length of said anchor cord.

14. The method of claim 13, further comprising the additional step of utilizing said device similar to an anchor when said anchor point is not available by lowering said device to a water body floor.

15. The method of claim 13, wherein said anchor point is a tree stump.

* * * * *